US010843204B2

(12) United States Patent
Stahl

(10) Patent No.: US 10,843,204 B2
(45) Date of Patent: Nov. 24, 2020

(54) MODULAR SHREDDER AND GRINDER APPARATUS

(71) Applicant: COURTRIGHT ENGINEERING COMPANY, LLC, Tallmadge, OH (US)

(72) Inventor: Mark A. Stahl, Barberton, OH (US)

(73) Assignee: COURTRIGHT ENGINEERING COMPANY, LLC, Tallmadge, OH (US)

( * ) Notice: Subject to any disclaimer, the term of this patent is extended or adjusted under 35 U.S.C. 154(b) by 0 days.

(21) Appl. No.: 15/770,769

(22) PCT Filed: Nov. 15, 2017

(86) PCT No.: PCT/US2017/061659
§ 371 (c)(1),
(2) Date: Apr. 25, 2018

(87) PCT Pub. No.: WO2018/132174
PCT Pub. Date: Jul. 19, 2018

(65) Prior Publication Data

US 2020/0055057 A1 Feb. 20, 2020

Related U.S. Application Data

(60) Provisional application No. 62/444,432, filed on Jan. 10, 2017.

(51) Int. Cl.

| | |
|---|---|
| ***B02C 21/00*** | (2006.01) |
| ***B02C 18/14*** | (2006.01) |
| ***B02C 18/18*** | (2006.01) |

(52) U.S. Cl.
CPC ..... *B02C 21/00* (2013.01); *B02C 18/142* (2013.01); *B02C 18/148* (2013.01);
(Continued)

(58) Field of Classification Search
CPC ..... B02C 2018/147; B02C 18/142; B02C 18/182; B02C 18/184; B02C 18/144;
(Continued)

(56) References Cited

U.S. PATENT DOCUMENTS 4,394,983 A * 7/1983 Ulsky ..... B02C 18/146 241/243
4,738,404 A * 4/1988 Mitchell ..... B02C 18/148 241/285.2

(Continued)

OTHER PUBLICATIONS

International Search Report dated Feb. 22, 2018 in related application No. PCT/US2017/061659.

(Continued)

*Primary Examiner* — Adam J Eiseman
*Assistant Examiner* — Bobby Yeonjin Kim
(74) *Attorney, Agent, or Firm* — Renner Kenner Greive Bobak Taylor & Weber

(57) ABSTRACT

A modular shredder and grinder apparatus includes a grinder assembly that has a grinder shaft assembly. The grinder assembly has a grinder opening and a shredder assembly movable with respect to the grinder opening to allow access to the grinder shaft assembly. Scrap material is first fed into the shredder assembly so that shredded scrap material is received through the grinder opening and further cut by the grinder shaft assembly.

10 Claims, 16 Drawing Sheets

(52) U.S. Cl.
CPC ..... *B02C 18/184* (2013.01); *B02C 18/186* (2013.01); *B02C 2018/147* (2013.01)

(58) Field of Classification Search
CPC ... B02C 18/186; B02C 18/22; B02C 18/2225; B02C 18/2291; B02C 2018/162; B02C 2013/2869; B02C 2013/28672; B02C 23/02
See application file for complete search history.

(56) References Cited

U.S. PATENT DOCUMENTS 5,971,305 A * 10/1999 Davenport ..... B02C 18/0084 241/197
6,343,755 B1 * 2/2002 Barclay ..... B02C 18/142 241/236
2002/0047062 A1 * 4/2002 Keskula ..... B02C 18/146 241/294
2002/0148917 A1 * 10/2002 Koenig ..... B02C 18/146 241/30
2003/0075626 A1 * 4/2003 Maguire ..... B02C 18/2291 241/30
2006/0086854 A1 * 4/2006 Diemunsch ..... B29B 17/0412 241/236
2006/0219826 A1 * 10/2006 Yamamoto ..... B02C 18/0007 241/30
2007/0057101 A1 * 3/2007 Rogers ..... B02C 18/18 241/293
2010/0133370 A1 * 6/2010 Flynn ..... B02C 23/20 241/46.01
2010/0147593 A1 * 6/2010 Hariharan ..... E21B 21/066 175/66
2012/0061498 A1 * 3/2012 Pallmann ..... B02C 18/144 241/73
2013/0214075 A1 * 8/2013 Abeln ..... B02C 18/18 241/236
2014/0166789 A1 * 6/2014 Yamamoto ..... B02C 21/026 241/29
2015/0083835 A1 * 3/2015 Lowe ..... B02C 18/2258 241/30
2016/0082443 A1 * 3/2016 Nydam ..... B02C 18/0092 241/46.06

OTHER PUBLICATIONS

Written Opinion dated Feb. 22, 2018 in related application No. PCT/US2017/061659.

* cited by examiner

MODULAR SHREDDER AND GRINDER APPARATUS

CROSS-REFERENCE TO RELATED APPLICATION

This is a § 371 application of International patent application No. PCT/US2017/061659 filed Nov. 15, 2017, which claims the benefit of U.S. provisional patent application No. 62/444,432 filed Jan. 10, 2017, and which are incorporated herein by reference.

TECHNICAL FIELD

The present invention is directed to a modular shredder and grinder apparatus which has modular cutter assemblies and modular grinder assemblies. More particularly, the present invention is directed to a modular shredder and grinder apparatus wherein the major components are movable with respect to one another to allow for servicing of those components. Specifically, the present invention is directed to a modular shredder and grinder apparatus which provides for modular shredding and grinding shafts to allow for replacement of cutting blades and related components.

BACKGROUND ART

Prior art shredding and grinding apparatuses are used to process scrap plastic material from molding machines and the like. Once a plastic part is molded, any scrap material such as sprues and improperly formed parts are placed into a shredder and grinder apparatus so that that material may be ground up and later mixed with virgin plastic material for re-use. Although the material inserted into the apparatus may be somewhat pliable in view of its elevated temperature, the materials typically contain fillers and the like which cause significant wear on the shredding and grinding components of the apparatus that cut the material. As such, when the components are excessively worn they must be replaced.

It is well known that there are standalone shredder assemblies and standalone grinder assemblies. There are also combination shredder and grinder assemblies. Most prior art constructions of shredder and grinder apparatuses are typically of a welded or unitary construction so as to ensure the stability of the apparatus; however, such a construction does not facilitate the replacement of component parts. Therefore, there is a need in the art for a modular shredder and grinder apparatus which allows for servicing of the apparatus to allow replacement of worn parts with minimal down time. And there is also a need to provide modular cutter assemblies in the shredder assembly and a modular grinder shaft assembly used in the grinding assembly.

SUMMARY OF THE INVENTION

In light of the foregoing, it is a first aspect of the present invention to provide a modular shredder and grinder apparatus.

It is another aspect of the present invention to provide a modular shredder and grinder apparatus, comprising a grinder assembly having a grinder shaft assembly, the grinder assembly having a grinder opening, and a shredder assembly movable with respect to the grinder opening to allow access to the grinder shaft assembly, wherein scrap material is first fed into the shredder assembly so that shredded scrap material is received through the grinder opening and further cut by the grinder shaft assembly.

In a further aspect of the present invention the apparatus also provides a grinder cabinet having a grinder opening therethrough, a pair of opposed rails carried on opposed sides of the grinder cabinet, wherein the shredder assembly includes a plurality of rollers extending therefrom and riding on the pair of opposed rails to move with respect to said grinder opening. The grinder shaft assembly provides a grinder shaft, and a plurality of supports spaced apart and disposed on the grinder shaft, where each support has at least one blade notch, and wherein the blade notches are aligned with each other so that a blade may be received in the notches.

In still another aspect of the present invention, the shredder assembly provides a chopper housing positionable over the grinder opening, wherein the chopper housing has a chopper housing opening, at least one cutter assembly carried by the chopper housing, and a hood assembly positionable over the chopper housing opening. In one configuration, a hood lifting assembly may be coupled between the chopper housing and the hood assembly, wherein the hood lifting assembly may move the hood assembly between a closed position covering the chopper housing opening and an open position that exposes the at least one cutter assembly. In another configuration the at least one cutter assembly provides a cutter shaft, which has a cutter key extending lengthwise for a majority of the cutter shaft, and a plurality of cutter blades disposed on the cutter shaft and oriented with respect to one another by the cutter key. The cutter shaft may also provide a plurality of spacers interleaved with the plurality of cutter blades and disposed on the cutter shaft, wherein each cutter blade is removable from the cutter shaft for replacement.

In still a further aspect of the present invention, each cutter blade provides a body having a shaft opening therethrough, wherein the shaft opening has a shaft keyway that is slidably received on the cutter key, and wherein the body has at least one insert opening. A cutter insert is received in the insert opening, and each cutter insert has a cutting edge, wherein each cutter blade has an angular orientation of the shaft keyway so that one of the plurality of cutter blades adjacent another of the plurality of cutter blades are non-aligned with each other.

In still another aspect of the present invention, the chopper housing rotatably receives a pair of the cutter assemblies, wherein each cutter assembly rotates in a direction opposite the other cutter assembly, and wherein a first cutter assembly is interleaved with a second cutter assembly such that adjacent plurality of cutter blades from the first cutter assembly pass between adjacent plurality of cutter blades from the second cutter assembly during their rotation. The chopper housing may also provide a plurality of wipers inwardly extending from the chopper housing, wherein each wiper fits in between the plurality of cutter blades from either the first or second cutter assembly.

In yet another aspect of the present invention, the shredder assembly provides a cutter shaft which has a cutter key extending lengthwise for a majority of the cutter shaft, a plurality of cutter blades disposed on the cutter shaft and oriented with respect to one another by the cutter key, a plurality of spacers interleaved with the plurality of cutter blades and disposed on the cutter shaft, wherein each cutter blade is removable from the cutter shaft for replacement. In this configuration, the chopper housing rotatably receives a pair of the cutter assemblies, wherein each cutter assembly rotates in a direction opposite the other cutter assembly, and wherein a first cutter assembly is interleaved with a second cutter assembly such that adjacent plurality of cutter blades from the first cutter assembly pass between adjacent plurality of cutter blades from the second cutter assembly during their rotation.

In still another aspect of the present invention, the apparatus provides a grinder cabinet which has the grinder opening therethrough, a pair of opposed rails carried on opposed sides of the grinder cabinet, and wherein the shredder assembly has a plurality of rollers extending therefrom and riding on the pair of opposed rails to move with respect to the grinder opening. In this aspect, the shredder assembly further provides a chopper housing positionable over the grinder opening, wherein the chopper housing has a chopper housing opening, at least one cutter assembly carried by the chopper housing, and a hood assembly positionable over the chopper housing opening.

It is still another aspect of the present invention to provide a cutter assembly having a cutter shaft with at least one cutter key extending lengthwise thereon, and a plurality of cutter blades disposed on the cutter shaft, each cutter blade having at least one insert opening that receives a cutter insert, wherein each cutter blade has an angular orientation with respect to the cutter key so that at least one of the plurality of cutter blades is non-aligned with an adjacent cutter blade. Moreover, each cutter blade has a body with a shaft opening therethrough with a shaft keyway that slidably receives the cutter key, wherein the body has at least one insert opening, and a cutter insert received in the at least one insert opening and having a cutting edge. And in some embodiments, a plurality of spacers are interleaved with the plurality of cutter blades and disposed on the cutter shaft, wherein each cutter blade is removable from the cutter shaft for replacement.

It is still yet another aspect of the present invention to provide a grinder shaft assembly having a grinder shaft, a plurality of supports spaced apart and disposed on the grinder shaft, wherein each support has at least one blade notch so that the blade notches are aligned with each other, and a blade received in the aligned blade notches. In some embodiments, each support has a plurality of blade notches aligned with respective blade notches of other supports so as to receive a corresponding blade. And in some configurations, each blade may be angularly skewed with respect to the grinder shaft.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
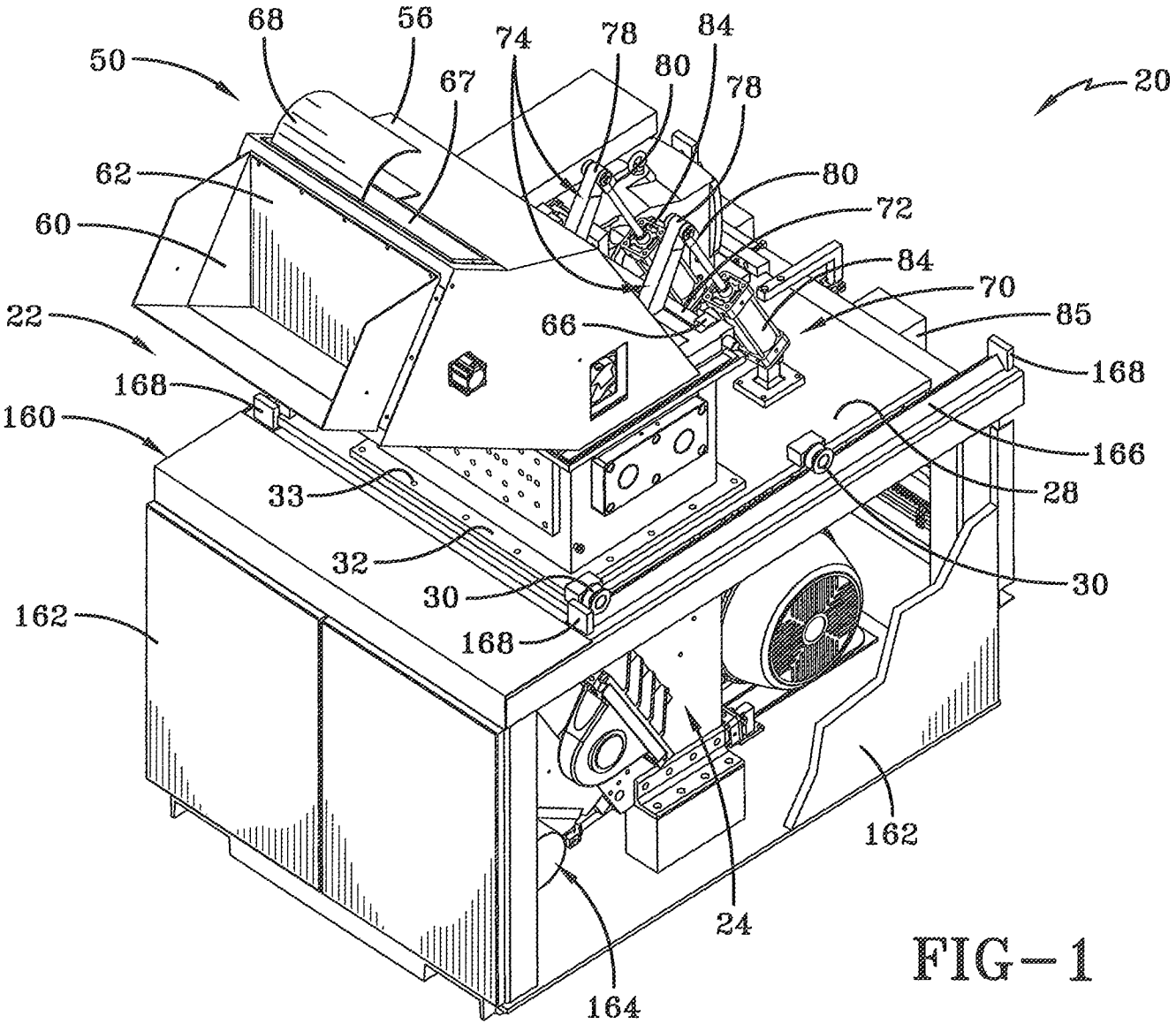
FIG. 1 is a perspective view of a modular shredder and grinder apparatus according to the concepts of the present invention.
Figure 2:
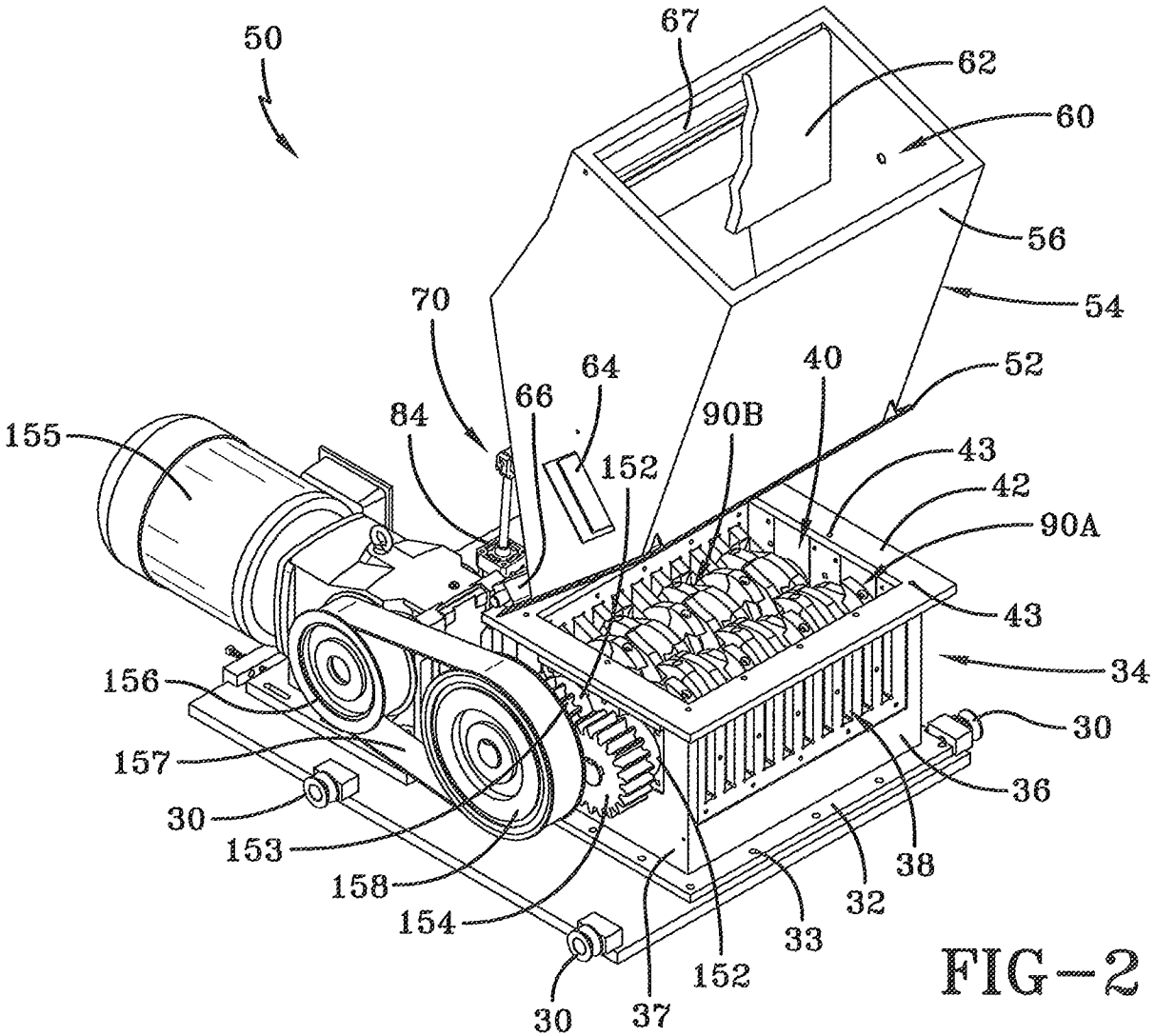
FIG. 2 is a perspective view, with guards removed, of a shredder assembly of the apparatus with a shredder hood moved to an open position according to the concepts of the present invention.
Figure 3:
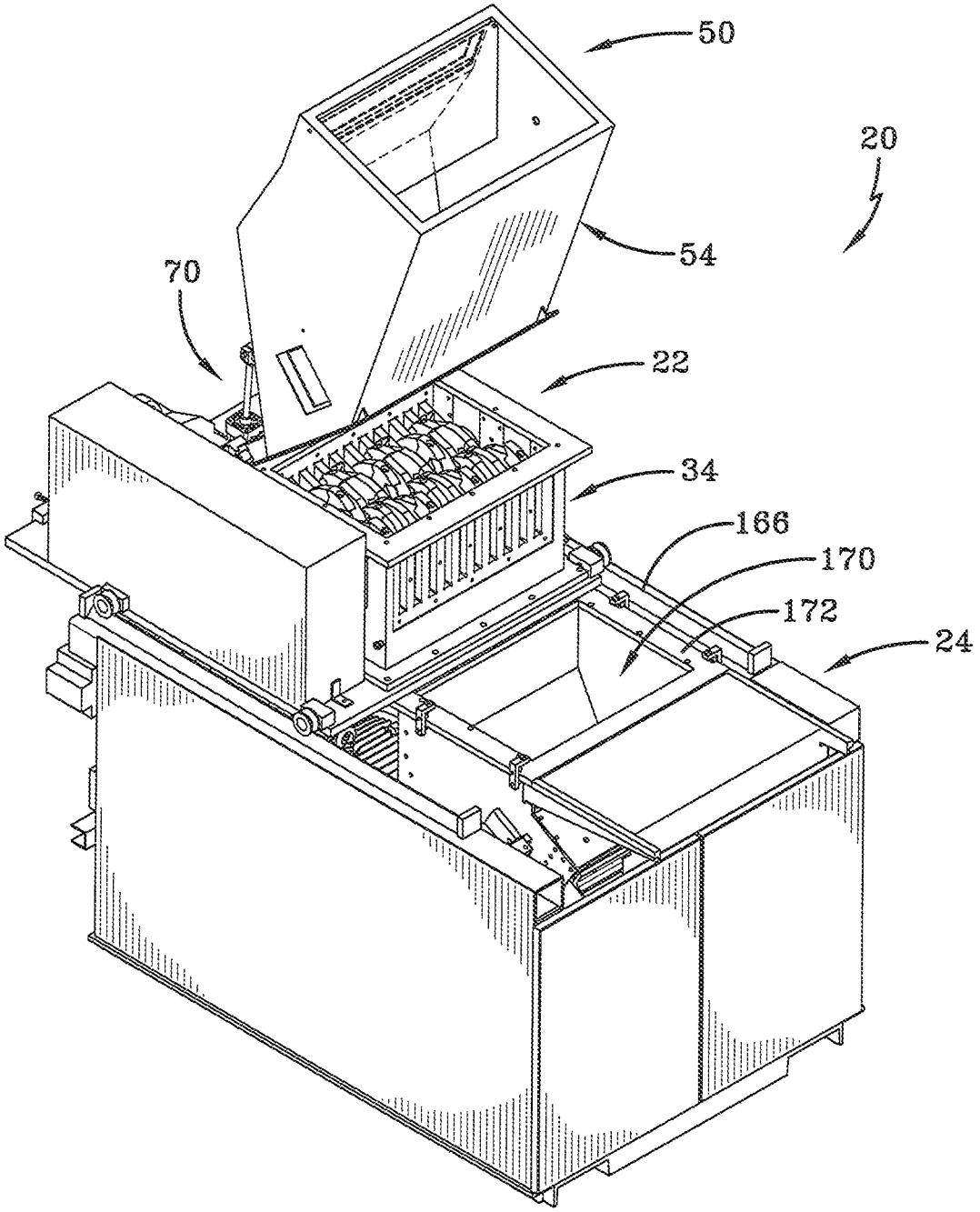
FIG. 3 is a perspective view of the shredder assembly moved to an open position with respect to a grinder assembly according to the concepts of the present invention.

Referring now to the drawings and in particular to FIGS. 1-3, a modular shredder and grinder apparatus is designated generally by the numeral 20. Generally, the apparatus 20 receives sprues, runners, defective plastic parts and other scrap plastic components from plastic molding operations and first shreds them into lengthwise strips and then grinds the strips into pellets or "re-grind" for re-mixing into other materials for later use. Generally, the assembly 20 includes a shredder assembly 22 which is movable with respect to a grinder assembly 24, which serves as a base for the assembly 22.

The shredder assembly 22 may include a base plate 28 from which laterally extends a plurality of rollers 30. The rollers may be movable on the grinder assembly 24 so as to allow for servicing of the grinder assembly 24 as needed. Although four rollers 30 are shown, with two rollers at a front edge and two rollers at about a mid-point of the base plate, skilled artisans will appreciate that any number of rollers, ball-bearings, or the like may be employed so as to adequately support the weight of the shredder assembly and facilitate its movement.

The shredder assembly 22 may include a top flange 32 which may be bolted or otherwise fastened to the base plate 28 through holes 33. As will be described, there is an opening through the top flange 32 so as to allow for the shredded parts to flow into the grinder assembly 24. The use of removable fasteners through the holes 33 may allow for replacement of the shredder assembly and/or selected components thereof.

A chopper housing, which is designated generally by the numeral 34, may be fastened with bolts or the like to the top flange 32 wherein the chopper housing carries cutter assemblies that will be discussed later. It will be appreciated that the chopper housing 34 may be welded or otherwise secured to the top flange 32; however, in view of the modular construction of the apparatus 20 it is believed that the use of bolts and associated fasteners facilitate the ability to replace component parts as needed. In any event, the chopper housing 34 includes front and back walls 36 and connecting sidewalls 37 which are generally of a rectangular configuration. Each of the walls 36 may provide for wall openings 38 which may be used for ventilation or other purposes.

As best seen in FIGS. 2 and 3, the chopper housing 34 provides for a chopper housing opening 40. A housing flange 42 is disposed about a top edge of the walls 36 and 37. The housing flange 42 may provide mounting holes 43 as needed about an inner periphery of the housing flange 42 so as to facilitate connection of the flange 42 to a top surface of the walls 36 and 37. The mounting holes 43 may receive fasteners (not shown) for securing the housing flange 42 to the walls 36 and 37.

A hood assembly, designated generally by the numeral 50, is movable between an open and closed position with respect to the chopper housing 34 and, in particular, the housing flange 42. The hood assembly 50 includes a chute plate 52 which forms an underside of the hood assembly 50 and which has an opening therethrough. The chute plate 52 may be sized and shaped to substantially match that of the housing flange 42. Extending upwardly from the chute plate 52 is a chute 54 through which the plastic items to be shredded pass. The chute 54 includes a chute body 56 which comprises connected walls which extend upwardly and angularly from the chute plate 52. The walls may include internal or external sound absorbing material as deemed appropriate. The chute body 56 provides for a chute opening 60 through which the plastic materials to be shredded are received. A movable flap 62 may extend over the chute opening 60 so as to protect against plastic material being ejected from the chute as it is being shredded. The body 56 may provide a vent 67 on at least a top wall which may provide for a safety cover 68. The vent 67 allows for any heat buildup within the shredder assembly 22 and the grinder assembly 24 to be exhausted. One or more of the walls of the chute body 56 may provide for an inspection port 64 so as to allow viewing of the flow of material through the hood assembly and into the chopper housing. In some embodiments, a second hood assembly (not shown), constructed in a similar manner, may be provided which provides for a relatively lower chute to receive the plastic material to be shredded. This lower hood assembly may be used to accommodate operator height or allow for feeding of the plastic material by conveyor. Both hood assemblies feed the plastic material into the chopper housing as described. A pair of collars 66, as best seen in FIG. 1, may extend from the chute plate 52 along a back edge thereof.

A hood lifting assembly is designated generally by the numeral 70 and may be coupled between the hood assembly 50 and the chopper housing 34. The hood lifting assembly 70 may include a lifting rod 72 which extends between the collars 66. A pair of tilt levers 74 are coupled to respective ends of the lifting rod 72. One end of each tilt lever is coupled to the rod. An opposite end of each tilt lever 74 includes a clevis end 78 which is attached to a clevis 80. A pivot cylinder 84 has one end that is connected to the clevis 80 of each lever. The cylinder 84 includes a moveable piston, wherein the cylinder is operatively connected to a control system 85 that initiates movement of the piston such as by a hydraulic fluid, compressed air, or by an electrical motor. Accordingly, actuation of the pivot cylinders 84 allow for partial rotatable movement of the hood assembly 50 from the chopper housing 34. This allows for access to the underside of the hood assembly 50 to remove any materials that may be clogging the chute 54 and also to inspect the cutter assemblies (to be discussed) maintained by the chopper housing.

Figure 4:
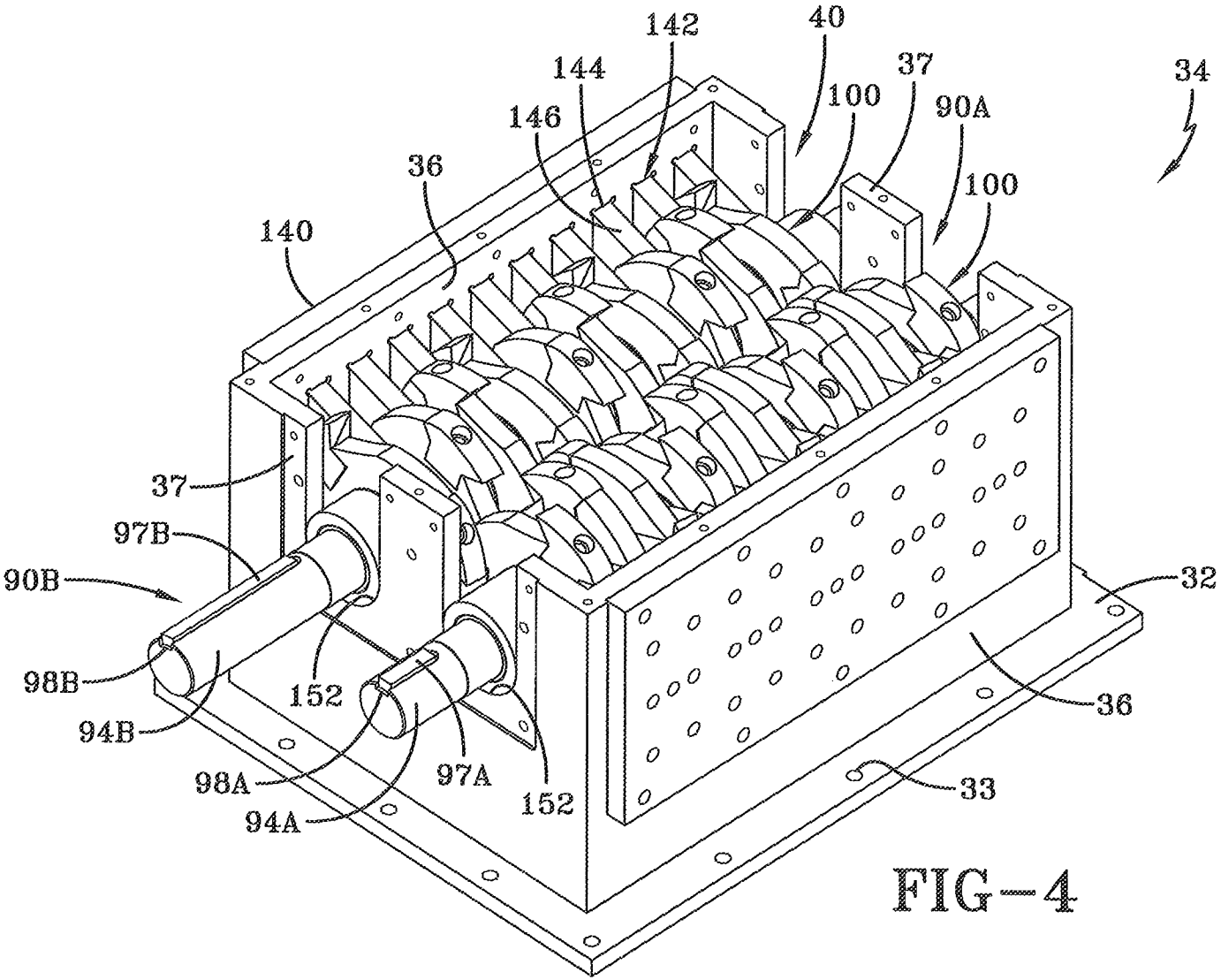
FIG. 4 is a perspective view of a chopper housing, which is a part of the shredder assembly, with cutter assemblies according to the concepts of the present invention.
Figure 5:
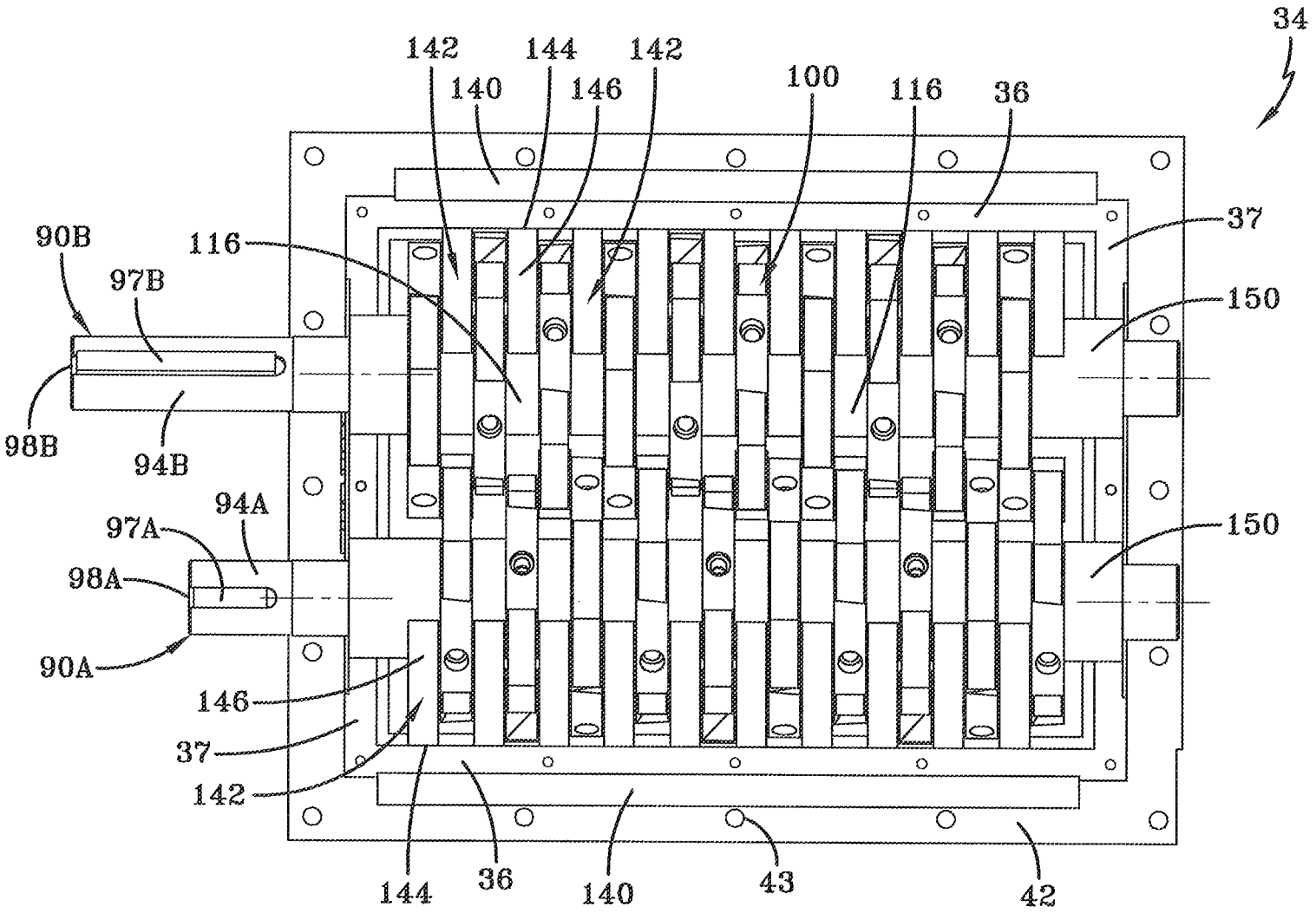
FIG. 5 is a top view of the chopper housing with cutter assemblies according to the concepts of the present invention.
Figure 6:
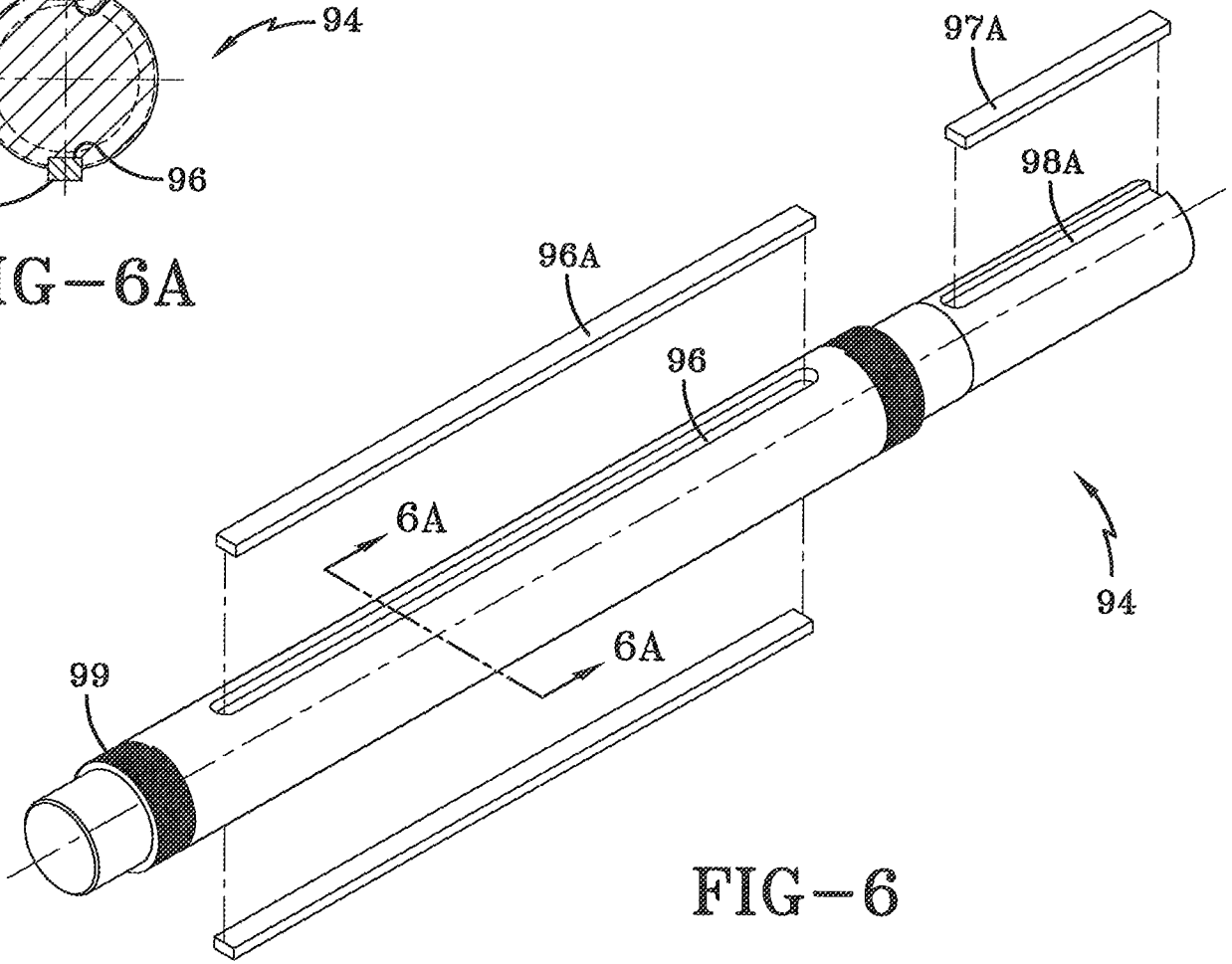
FIG. 6 is an exploded perspective view of a cutter shaft and inserted keyway used in a cutter assembly according to the concepts of the present invention.
Figure 6A:
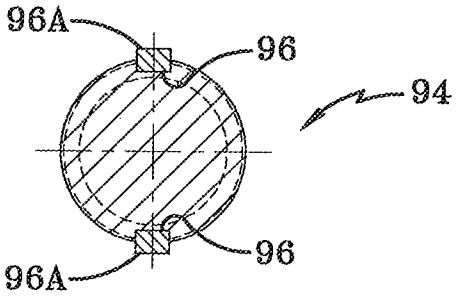
FIG. 6A is a cross-sectional view of the cutter shaft and inserted keyway taken along lines 6A-6A of FIG. 6 according to the concepts of the present invention.

As best seen in FIGS. 4-6 and 6A, a pair of cutter assemblies 90A and 90B are rotatably received in the chopper housing 34. As will become apparent as the detailed description proceeds, the material inserted in to the chute opening 60 falls into the chopper housing 34. The cutter assemblies 90 are configured so as to shred the received material so that it exits into the grinder assembly 24 positioned underneath the chopper housing. Each cutter assembly 90 includes a cutter shaft 94 as best seen in FIG. 6. Where appropriate, A and B suffixes are used to designate the differences between the cutter assemblies 90. One difference is the length of the shafts, wherein shaft 94B is longer than shaft 94A to allow for engagement with a drive motor that rotates the cutter assemblies. However, the shafts are of substantially of the same configuration. Each cutter shaft 94 provides for a cutter keyway 96 on opposed sides that extend lengthwise along most of the shaft. A shaft key 96A is received and held in each keyway 96 by at least an interference fit. Skilled artisans will appreciate that other shaft constructions that provide for opposed protrusions may be employed to receive and carry cutter blades as will be discussed. Each cutter shaft 94 also provides for an opposed gear keyway 98 on opposed sides that extend from one end of the shaft lengthwise toward the cutter keyway 96. As shown, the gear keyways 98 do not extend all the way to the cutter keyway 96. Each gear keyway 98 receives and holds a gear key 97 with at least an interference fit. Each end of the shaft may provide threaded sections 99.

Referring now to FIGS. 7A-C and 8A-C, it can be seen that a cutter blade is designated generally by the numeral 100. Cutter blades are slidably received onto the cutter shaft 94 and secured in place. As shown in the FIGS. 7A and 8A; 7B and 8B; and 7C and 8C, there may be three cutter blades 100 with a corresponding suffix A, B or C corresponding to their different angular disposition on the cutter shaft. Skilled artisans will appreciate that any number of angular dispositions may be employed. The benefit of this is clearly evident in FIGS. 9 and 10, as will be described.

Each cutter blade 100 includes a body 102. Extending through the body 102 is a shaft opening 104 which has a pair of shaft keyways 106. Each body 104 may include an insert 107, which may be made of a different material than the remainder of the body 104, wherein the insert forms the shaft opening 104 and the keyways 106. The shaft keyways 106 may be in the form of two notches that are configured to be about 180° apart. The keyways 106 are aligned so as to slidably receive the shaft keys 96A and 96B when the cutter blades 100 are received on the corresponding shafts 94A, 94B. The body 102 may further provide an outer edge 108. The body 102 may be of a somewhat triangular configuration but with rounded edges in selected locations. Skilled artisans will appreciate that the body may be provided in any appropriate shape. Extending inwardly from the outer edge 108 at about each apex of the body's triangular configuration may be an insert opening 110. As such, each of the insert openings are spaced about 120° apart. If a different number of insert openings are desired they may be spaced apart in substantially equal angular increments. If appropriate, the angular increment spacing of the insert openings may be in staggered or unequal increments.

Figure 7A:
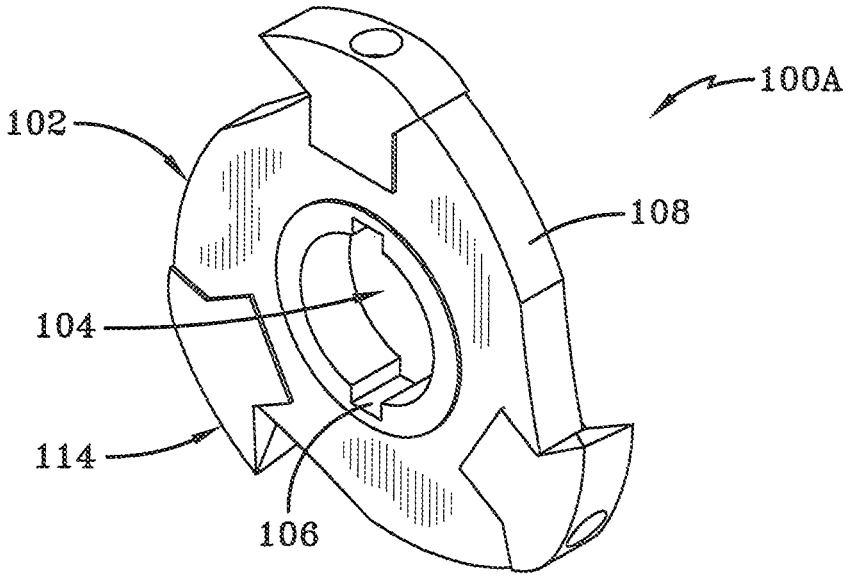
FIGS. 7A, 7B and 7C are perspective views of exemplary cutter blades used in the cutter assembly according to the concepts of the present invention.
Figure 8A:
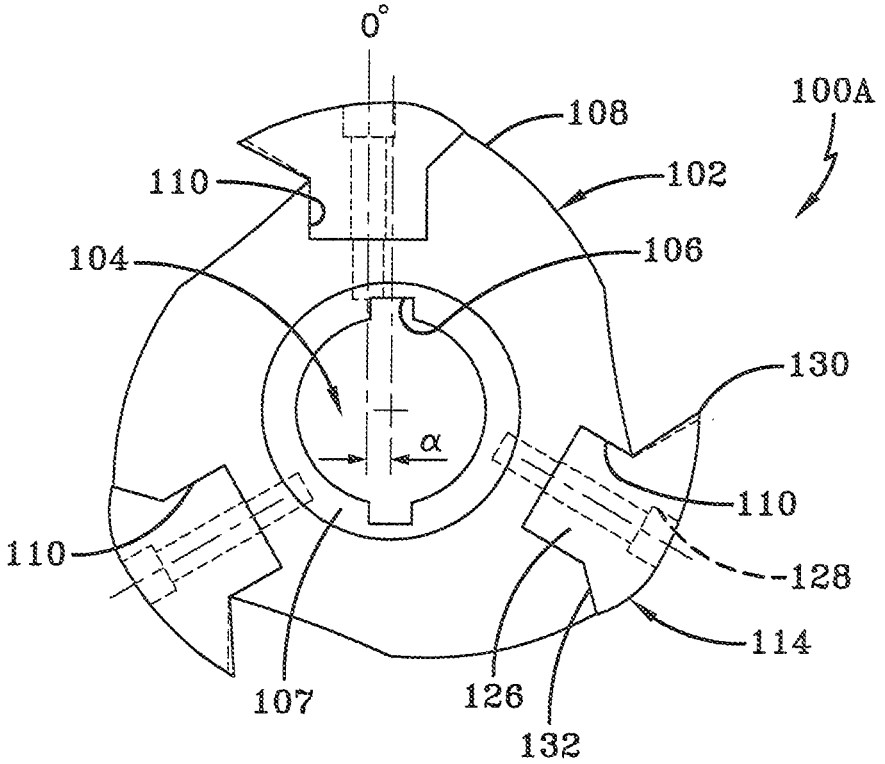
FIGS. 8A, 8B and 8C are elevational views of the exemplary cutter blades according to the concepts of the present invention.
Figure 7B:
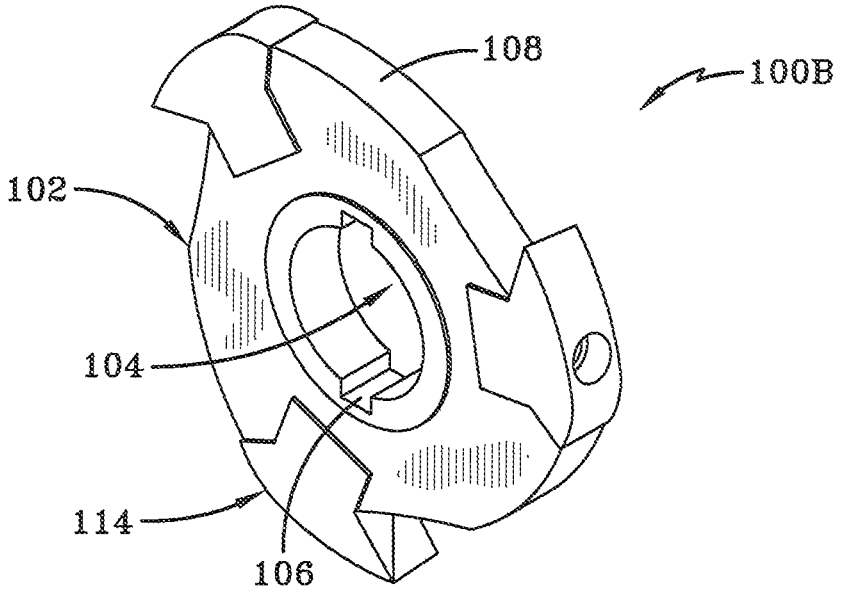
Figure 8B:
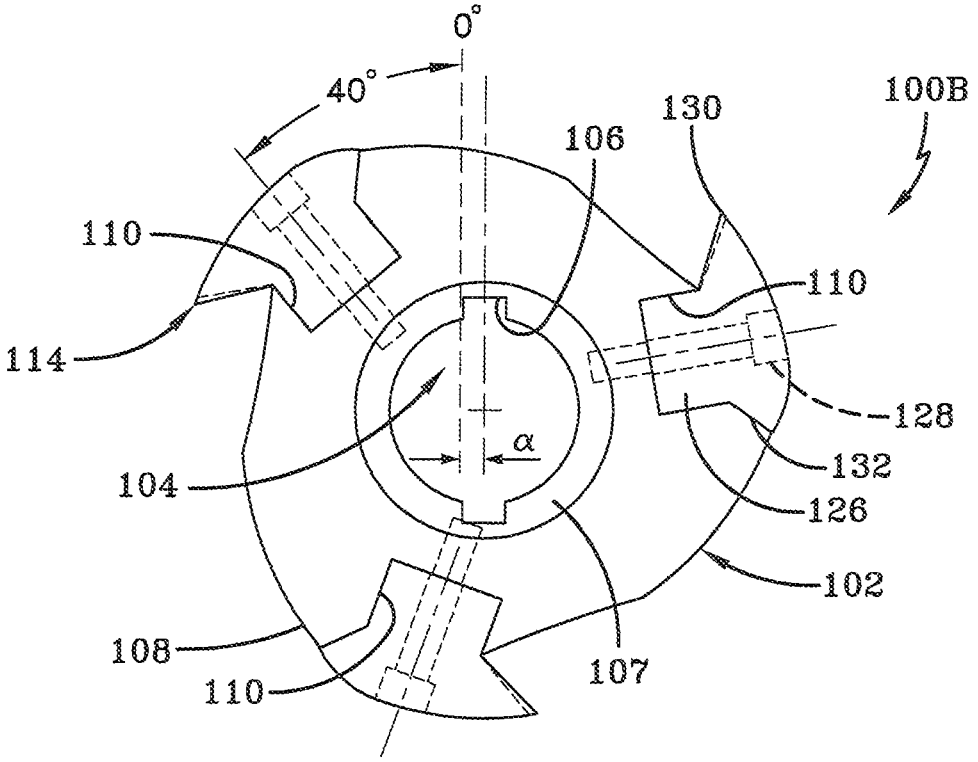
Figure 7C:
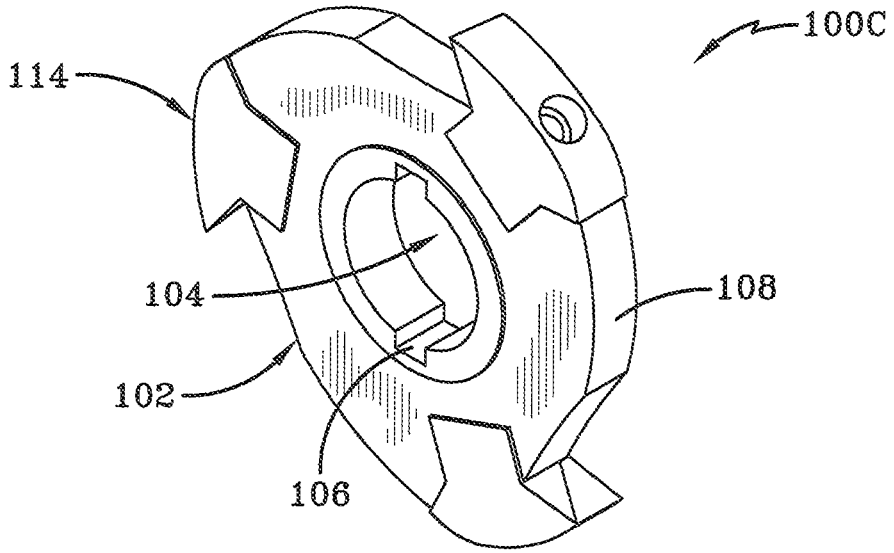
Figure 8C:
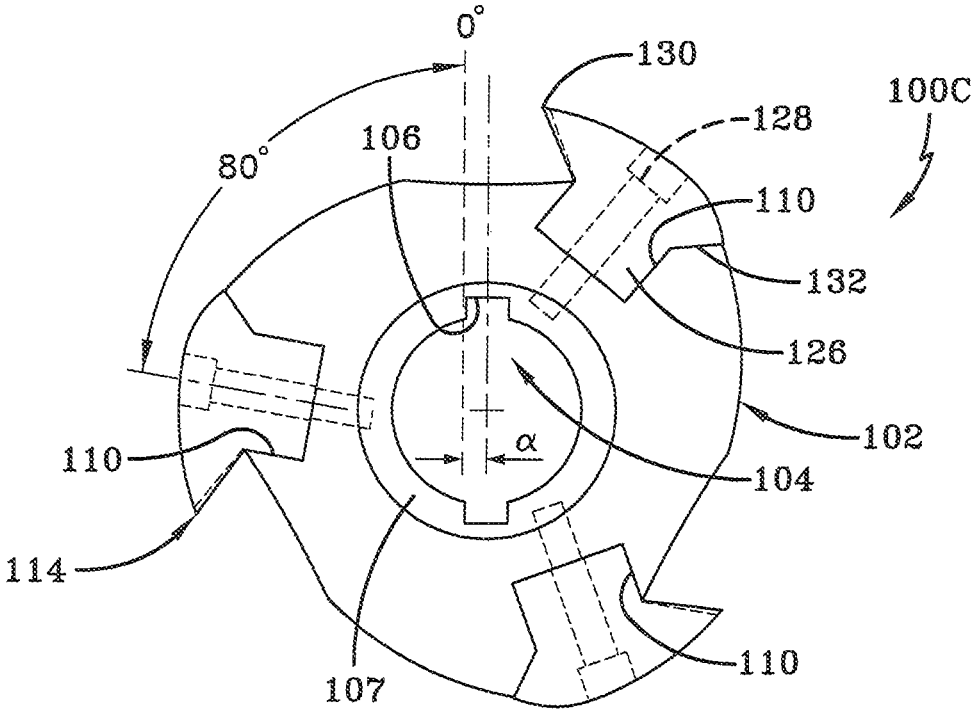

As noted above, the angular positions of the insert openings 110 with respect to the shaft keyways 106 may vary for each cutter blade 100. To establish these angular positions, a center line of a selected insert opening 110 (the 12 o'clock position in FIGS. 8A, 8B, and 8*c*) in the corresponding cutter insert 114, which may be established by the center line of the fastener that secures the insert into the insert opening, is dimensionally offset a predetermined amount (α) from a center origin of the shaft opening 104. In some embodiments this offset dimension may range between 0.125" to 0.625". And in the present embodiment the offset dimension is about 0.35". FIGS. 7A and 8A show that a reference cutter insert 114 (12 o'clock position) is offset the predetermined amount and oriented at about 0° in relation to the keyway 106 for cutter blade 100A. The cutter blade 100B is offset the predetermined amount and oriented at about a 40° in relation to the keyway 106 as shown in FIGS. 7B and 8B. And the cutter blade 100C, as shown in FIGS. 7C and 8C, is offset the predetermined amount and oriented at about 80° in relation to the keyway 106. Each of the remaining cutter inserts shown in FIGS. 8A-8C are oriented 120° from the reference cutter insert.

Figure 9:
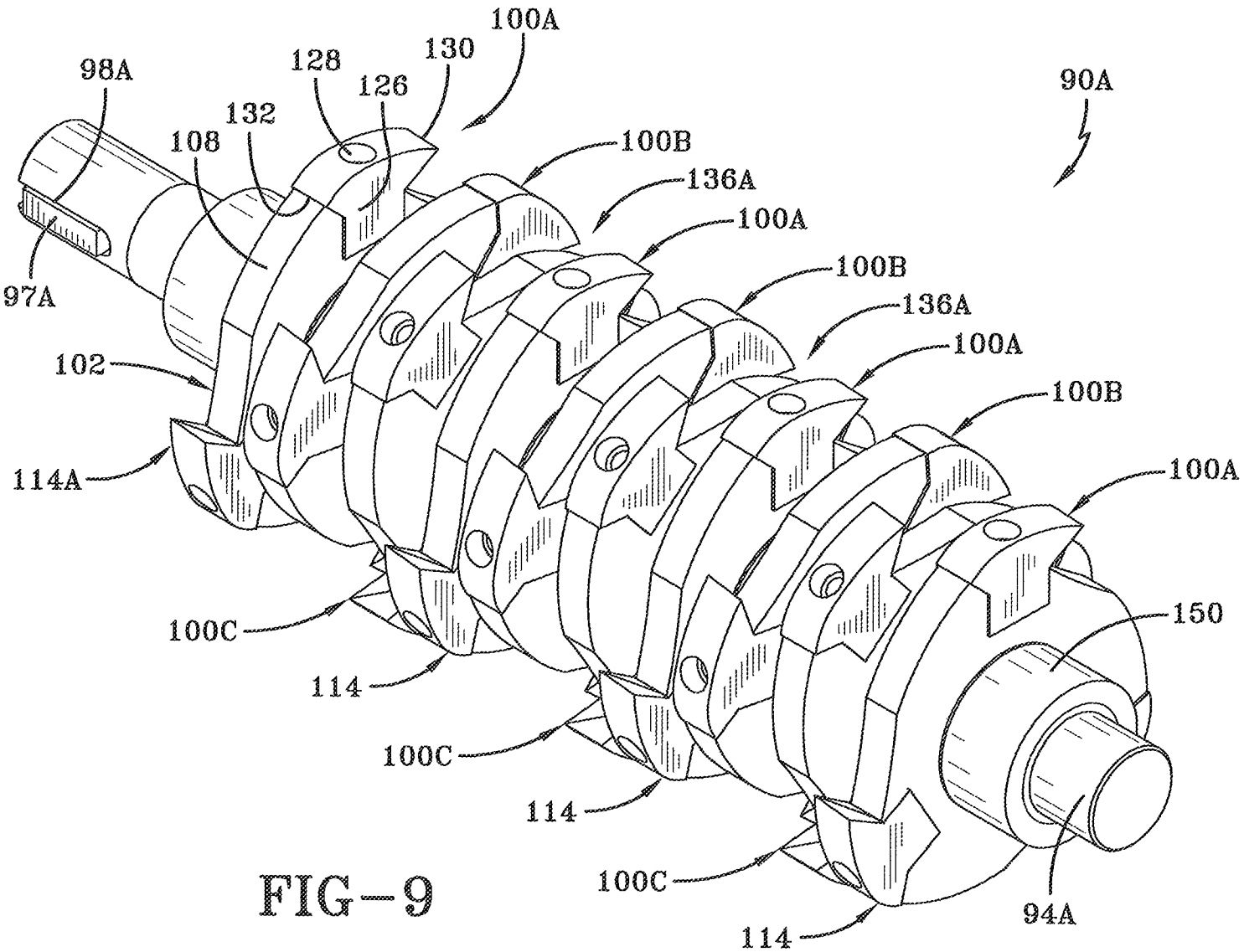
FIG. 9 is a perspective view of a first cutter assembly according to the concepts of the present invention.
Figure 10:
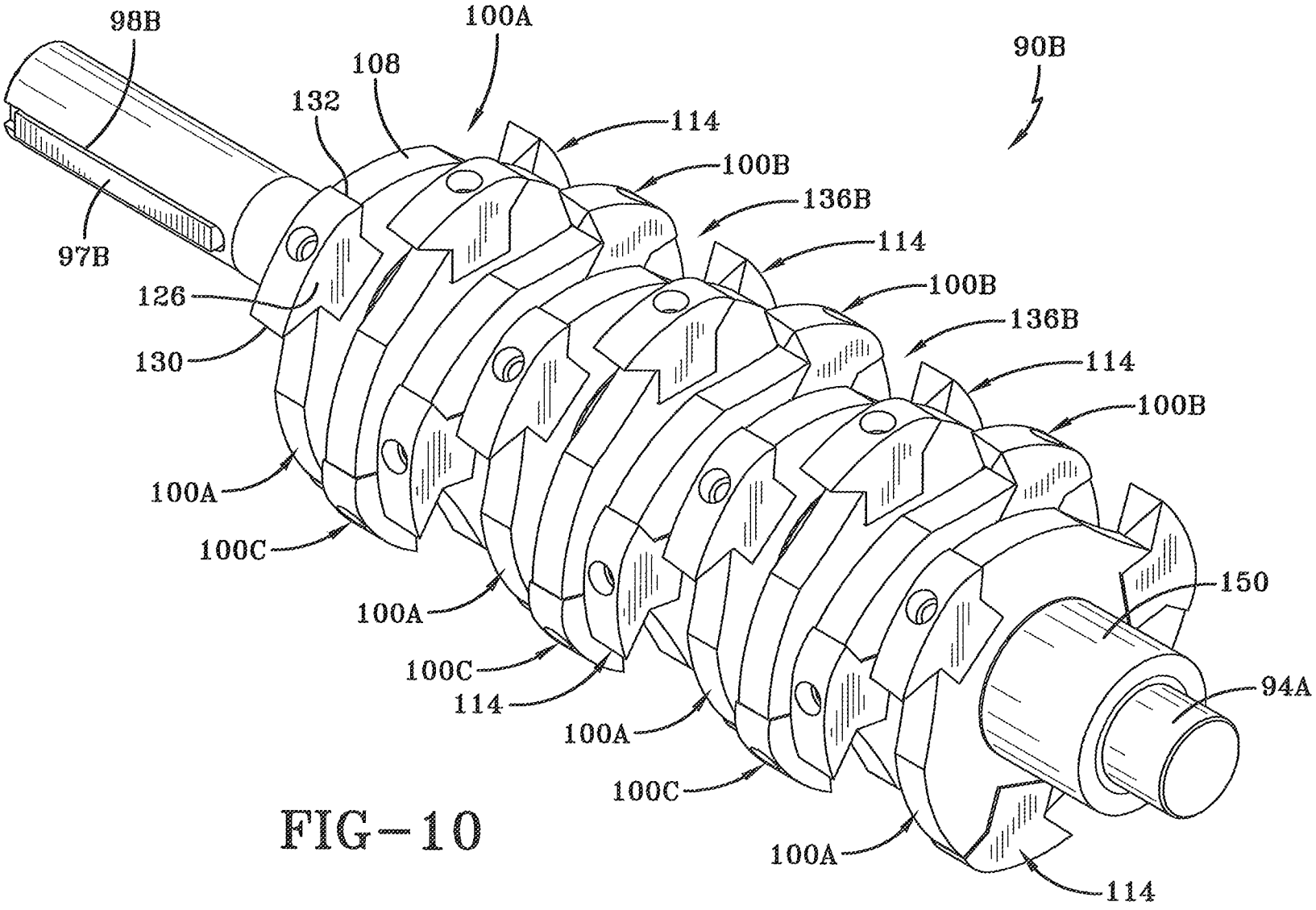
FIG. 10 is a perspective view of a second cutter assembly made in accordance with the concepts of the present invention.

A cutter insert 114 is receivable in each insert opening 110. Each cutter insert includes a cutter insert body 126 which has a counter bore 128 extending from an upper edge inwardly into the body 102. The counter bore 128 receives a fastener which connects and secures the insert to the cutter body. Each insert 114 includes a cutting edge 130 that angularly extends outwardly from the body and which is opposite a trailing edge 132, wherein the trailing edge provides a relatively uninterrupted and smooth transition to the adjacent outer edge 108. It will be appreciated that there may be multiple configurations of the cutter blade in regard to the different angular orientations of the cutter insert 114 with respect to the shaft keyways 106. The shaft key 96A is configured so as to match the cutter keyway 96 and to allow the body 102 to be movable along the cutter shaft 94. In this manner, individual cutter blades may be replaced when one of the cutting edges 130 become damaged or ineffective in operation. Additionally, the different angular orientations of the shaft keyway 106 with respect to the position of the insert openings 110 allows for the cutter inserts to be at different angular orientations with respect to the cutter blades. Accordingly, as best seen in FIGS. 9 and 10, adjacent cutter blades 100A, 100B, and 100C provide their respective cutter inserts 114 at different angular positions. In other words, adjacent cutter blades disposed along the shaft are provided with different angular orientations so as to improve the effectiveness of the cutter assembly as it rotates. As such, for some embodiments each cutter blade has a selected angular orientation with respect to the cutter key, and correspondingly to the shaft, so that each cutter blade may be non-aligned with an adjacent cutter blade. As a result, adjacent cutter blades may have a different angular orientation. Any arrangement of adjacent cutter inserts 114 may be employed.

Figure 11:
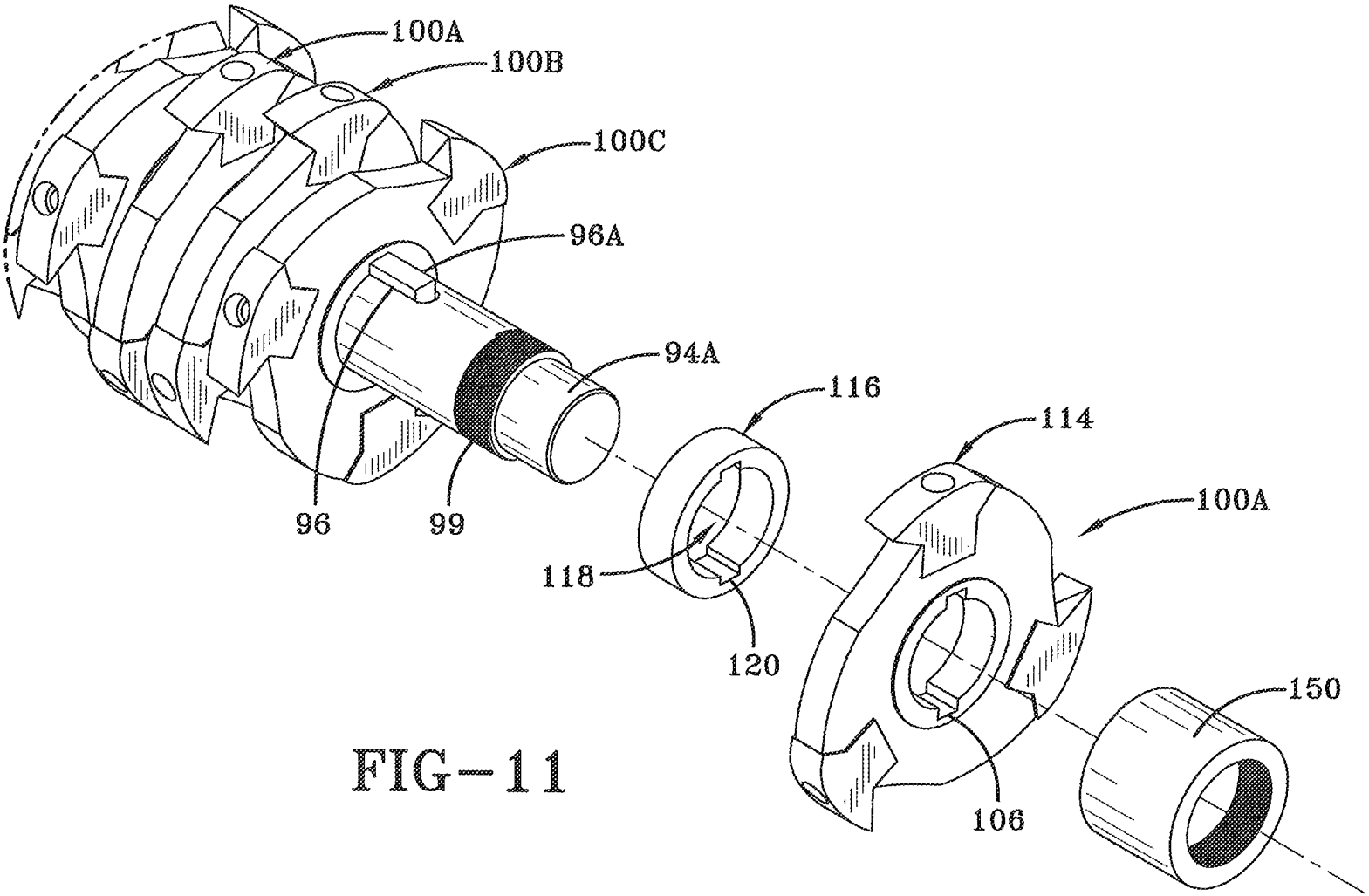
FIG. 11 is an exploded perspective view of a cutter shaft assembly end showing two of the cutter blades removed so as to show spacers that are positioned in between the removed cutter blades on the cutter shaft according to the concepts of the present invention.
Figure 12:
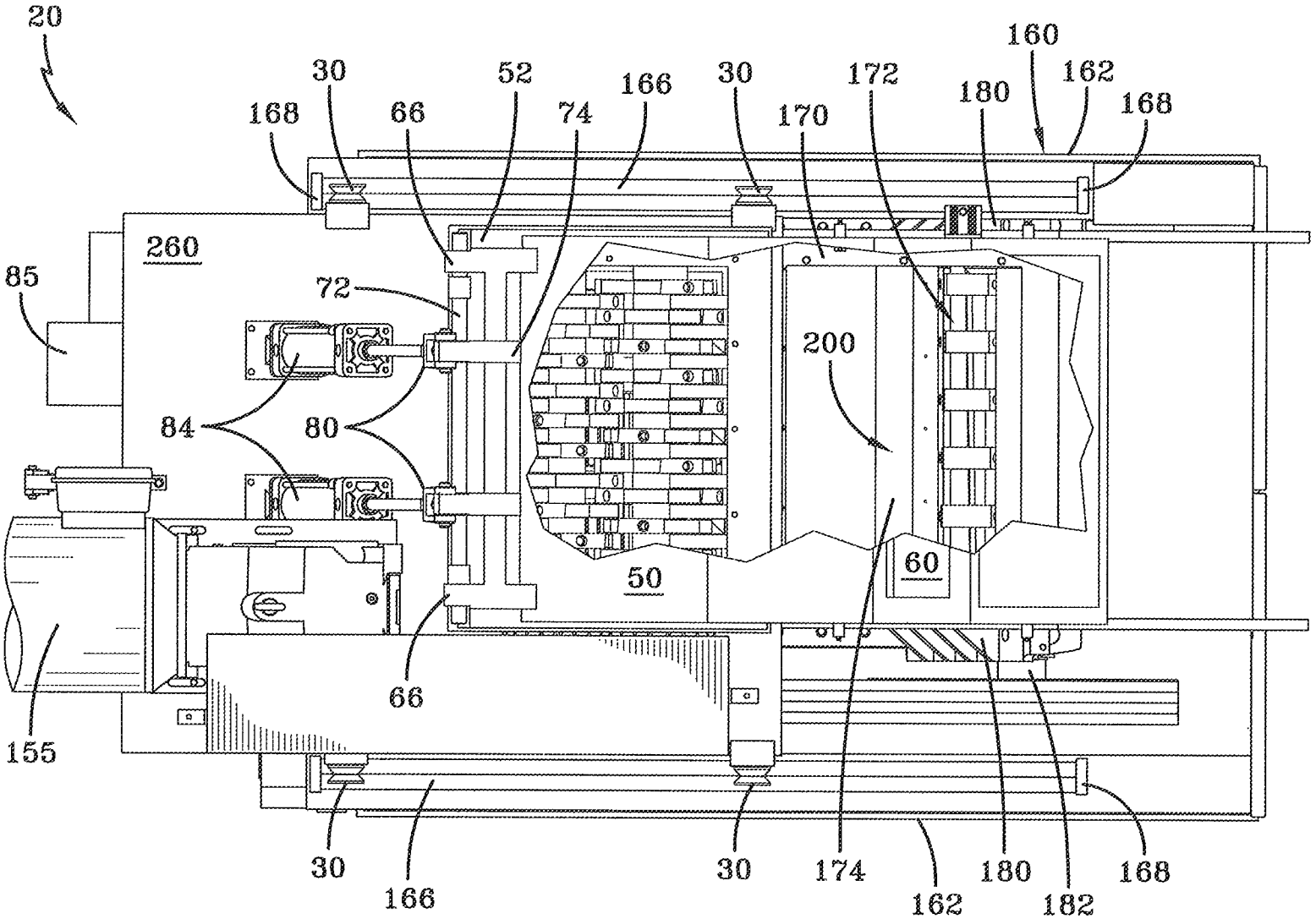
FIG. 12 is a top view of the apparatus showing the shredder assembly moved to an open position according to the concepts of the present invention.

Spacers 116 may be used to separate the cutter blades from one another. As best seen in FIG. 11, each spacer 116 has a spacer opening 118 which extends into opposed spacer keyways 120 that are aligned with and received on the keys 96A. The spacers 116 are sized to be substantially the same thickness of each cutter blade 100 or slightly larger so as to form gaps 136 therebetween when received on their respective shafts. As a result, when the cutter assembly 90A and cutter assembly 90B are installed into the chopper housing, the cutter blades 100 are positioned so that they are received in the corresponding gaps 136 of the other shaft formed between adjacent cutter blades. In other words, the cutter blades 100 on cutter assembly 90A fit into the corresponding gaps 136B formed between the adjacent cutter blades 100 of the cutter assembly 90B. Likewise, the cutter blades 100 on cutter assembly 90B fit into the corresponding gaps 136A between the adjacent cutter blades 100 of the cutter assembly 90A.

The interleaving of the cutter assemblies with one another can best be seen in FIGS. 4 and 5. To further assist the flow of shredded material through the chopper housing and prevent clogging, the chopper housing 34 may be provided with wipers to ensure that material does not accumulate between the cutter assemblies and the adjacent front and back walls of the chopper housing. To accomplish this, a wiper plate 140 may be mounted to a corresponding front and back wall 36 of the chopper housing. Secured through the walls and onto the wiper plate 140 are a plurality of wipers 142 which are sized to fit in the gaps 136 between the cutter blades of each cutter assembly. Each wiper 142 includes a back edge 144 that is connected to an inner surface of the walls 36 by fasteners extending from the wiper plate through the wall openings 38. Opposite the back edge 144 is a facing surface 146 which may be tapered with respect to the inner surface of the wall and is angularly directed toward the spacers of the cutter assembly. It will be appreciated that the wipers 142 are received in the respective insert gaps 136 such that any material that is propelled outwardly from the cutter assemblies during their rotation is directed back inward by the wipers toward the two cutter assemblies. It will further be appreciated that the cutter assemblies in the present embodiment are rotated in opposite directions and toward one another. As such, all material is directed in between the cutter assemblies as they rotate. Accordingly, it will further be appreciated, for example, that the cutter assembly 94B is rotated clockwise, while the cutter assembly 94A is rotated counter-clockwise. The sidewalls 36 of the chopper housing 34 are provided with journals 152 so as to allow for rotation of the cutter assemblies 94A and 94B in the chopper housing.

Referring now to FIGS. 9, 10 and 11, it can be seen that each of the cutter assemblies may provide for a holding ring 150 which has internal threads that mesh with the threaded sections 99 at each end of the shaft which secures the cutter blades and spacers into place on the cutter shaft. The holding rings 150 may be removed by unthreading or rotating them off of the shaft so as to allow for removal of selected cutter blades and/or spacers as needed.

As best seen in FIG. 2, it can be seen that the cutter assemblies each include a spur gear that is attached to an end of a corresponding cutter assembly. Attached to an end portion of the shaft 94B, which extends out of the chopper housing further than the other shaft 94A, is a spur gear 153 that fits on and engages the gear key 97B. Attached to an end of the shaft 94A is a spur gear 154 that fits on and engages the gear key 97A. The two spur gears 153 and 154 intermesh with each other so that as one gear rotates the other gear rotates in the opposite direction. Also attached to an end of the shaft 94B is a gear pulley 158 that rotates the shaft. A drive belt 157 is attached to the gear pulley 158 and is driven by a motor pulley 156 that is driven by a shredder motor assembly 155 which is connected to and operated by the control system. Accordingly, as a shaft of the motor assembly 155 rotates the motor pulley 156, the drive belt 157 likewise rotates the gear pulley 158. This, in turn, rotates the shaft 94B and the spur gear 153 which engages the spur gear 154. This causes the clockwise rotation of the cutter assembly 94B and the counter-clockwise rotation of cutter assembly 94A.

Referring now to FIGS. 1 and 12-14, the details of the grinder assembly 24 will be discussed. The grinder assembly 24 includes a grinder cabinet 160 which is made up of side panels 162, one of which may provide for an exit conduit 164 where the pelletized material generated by the grinder assembly is fed into a central station for further mixing with other materials or further use. The grinder cabinet 160 is formed upon a grinder cabinet frame 165 which includes a plurality of cabinet rails 166 along top opposed lateral edges of the cabinet, wherein the cabinet rails 166 carry the rollers 30 from the shredder assembly so as to allow its lateral movement into and out of operating positions. The cabinet rails 166 or other component of the cabinet frame 165 may provide for a grinder frame 170 which matches an opening formed by the underside of the chopper housing 34. This allows for continuous flow of the material exiting the chopper housing into the grinder assembly.

The grinder frame 170, which may be maintained within the interior of the grinder cabinet frame 165, provides for a grinder opening 172. The grinder opening 172 feeds into a grinder chute 174 which directs the shredded material into engagement with a grinder shaft assembly to be discussed. In some embodiments a shock absorber 176 may support the grinder frame with respect to one of the beams of the grinder cabinet frame 165. The absorber 176 absorbs the vibration of the grinder assembly so as to reduce noise and minimize wear on the apparatus 20. Pillow block brackets 180 may be positioned in between an outer area of the grinder chute 174 and the cabinet frame 165. The brackets 180 provide further structural support to the grinder assembly. A pair of opposed journals 182 are positioned on opposite sides of the chute 174 so as to rotatably receive a grinder shaft assembly designated generally by the numeral 200.

Figure 13:
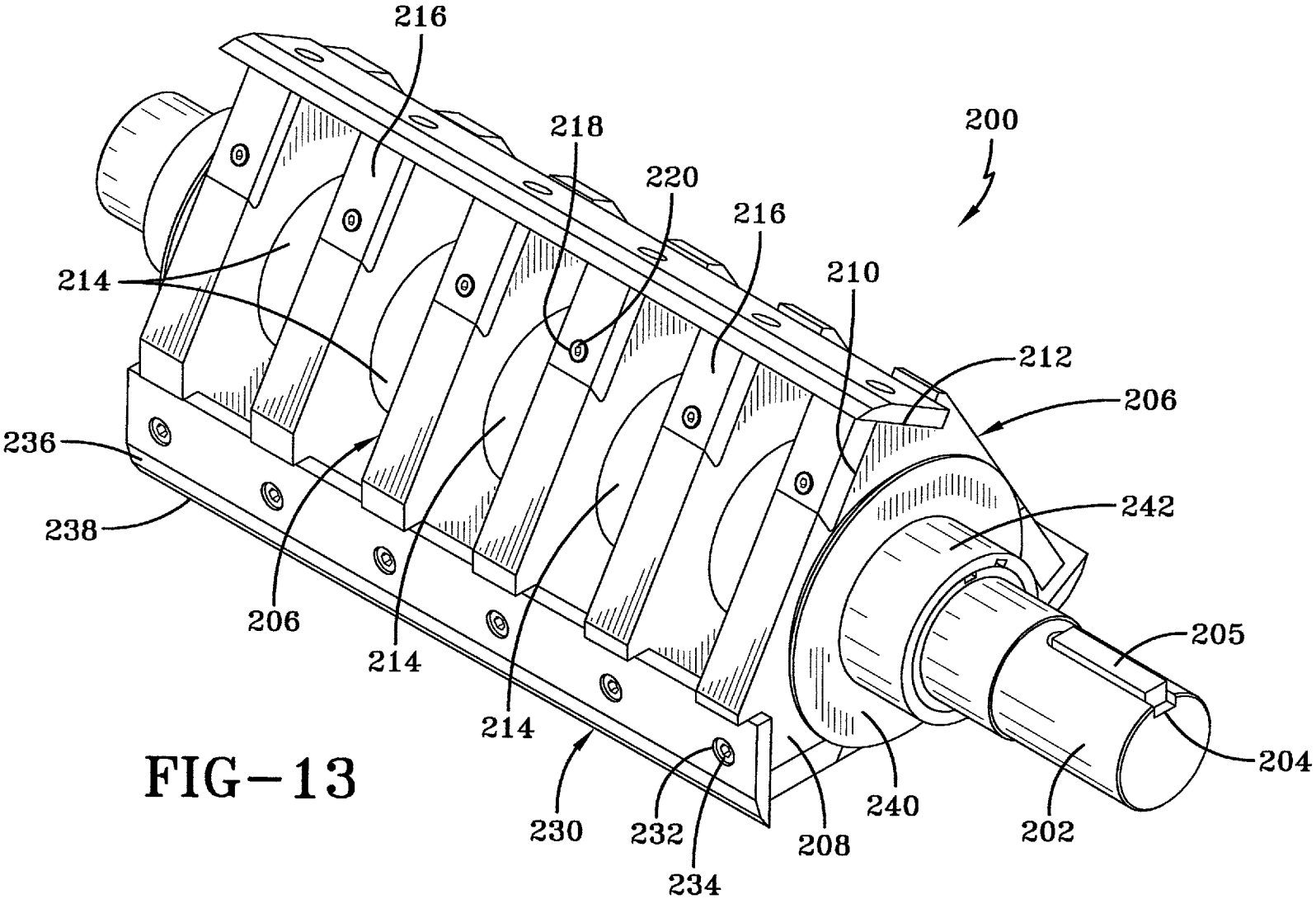
FIG. 13 is a perspective view of a grinder shaft assembly used in the grinder assembly according to the concepts of the present invention.

As best seen in FIG. 13, the grinder shaft assembly 200 includes a shaft 202 which has a key groove 204 at one end of the shaft which receives a key 205. The shaft 202 may carry a plurality of supports 206 wherein each of the supports is of a slightly different construction, the importance of which will be described later. Each support 206 includes a support body 208 which is of a somewhat triangular shape. At each apex of the triangular support body 208 is an insert notch 210 along one side of the apex and a blade notch 212 on an adjacent side of the apex. Received on the shaft 202 and interleaved between each of the support bodies 208 may be a support spacer 214. The spacers maintain the desired spacing between each of the support bodies 208.

Received in the insert notch 210 is an insert 216 which may be constructed of hardened steel or other similar material. The insert 216 includes a hole 218 which receives a fastener 220 which allows for securement of the insert 216 into the support body. A singular blade 230 is then received in a plurality of blade notches 212 along the length of the grinder shaft assembly 200. Each blade 230 has a plurality of holes 232 which are aligned with corresponding holes provided by the support body wherein fasteners 234 are received in the holes to fasten the blade 230 to each corresponding support body. Each blade 236 provides for a taper 236 which terminates at a knife edge 238.

Figure 13A:
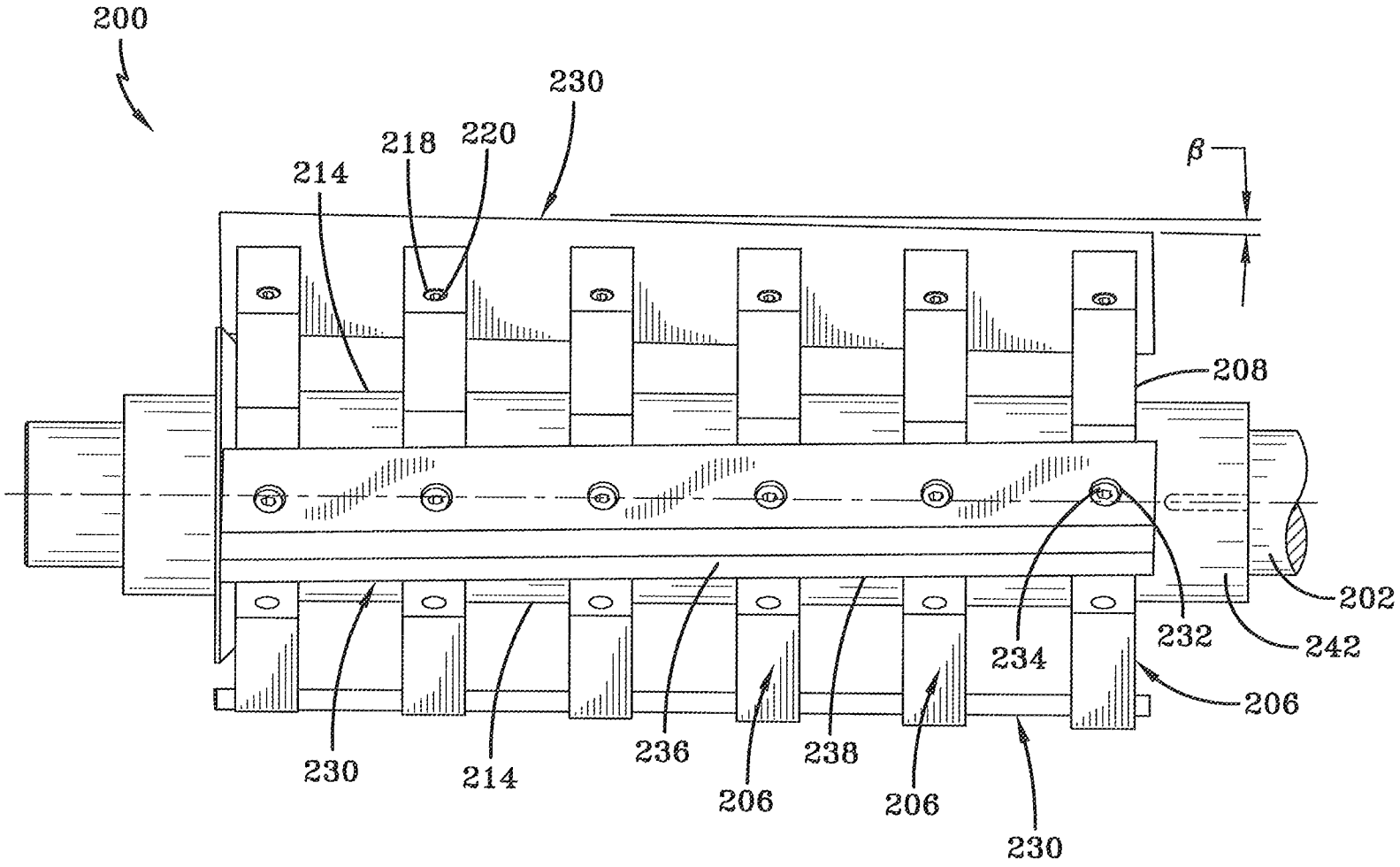
FIG. 13A is an elevational view of the grinder shaft assembly according to the concepts of the present invention.

Each support body may have a slightly different dimensional configuration for the insert notch 210 and the blade notches 212. This slight dimensional variation allows for the blade 230 that is received in the blade notch 212 to be somewhat angularly skewed (β) with respect to the shaft 202 as best seen in FIG. 13A. In other words, each blade 230 is held in a non-parallel orientation with respect to the shaft 202. This angular skewing facilitates cutting of the shredded material in an efficient and reliable manner. The grinder shaft assembly shown and described provides three rotating blades to effectively cut shreds received from the shredder assembly into pellets. Skilled artisans will appreciate that the support bodies may be shaped or configured to carry any number of blades. As such, grinder shaft assemblies may be configured to cut shredded scrap based on particular material properties.

The grinder shaft assembly 200 further provides for an endring 240 and a holding collar 242 to hold the support bodies 208 in place. When required, the blades may be removed by simply removing their fasteners and replacing an old blade with a new one into the blade notches. Additionally, the inserts, which support the underside of the blade and may absorb a significant amount of wear, may also be replaced at that time. If the support bodies become worn or damaged during operation, then the grinder shaft assembly 200 can be removed from the grinder assembly and with removal of the end ring 240 and the holding collar 242, the damaged support body can be removed and replaced. Skilled artisans will appreciate that the collar 242 may have internal threads that mate with external threads on the shaft 202. Or lateral set screws or other mechanism may be used to hold the support bodies 208 and support spacers 214 in place.

Figure 14:
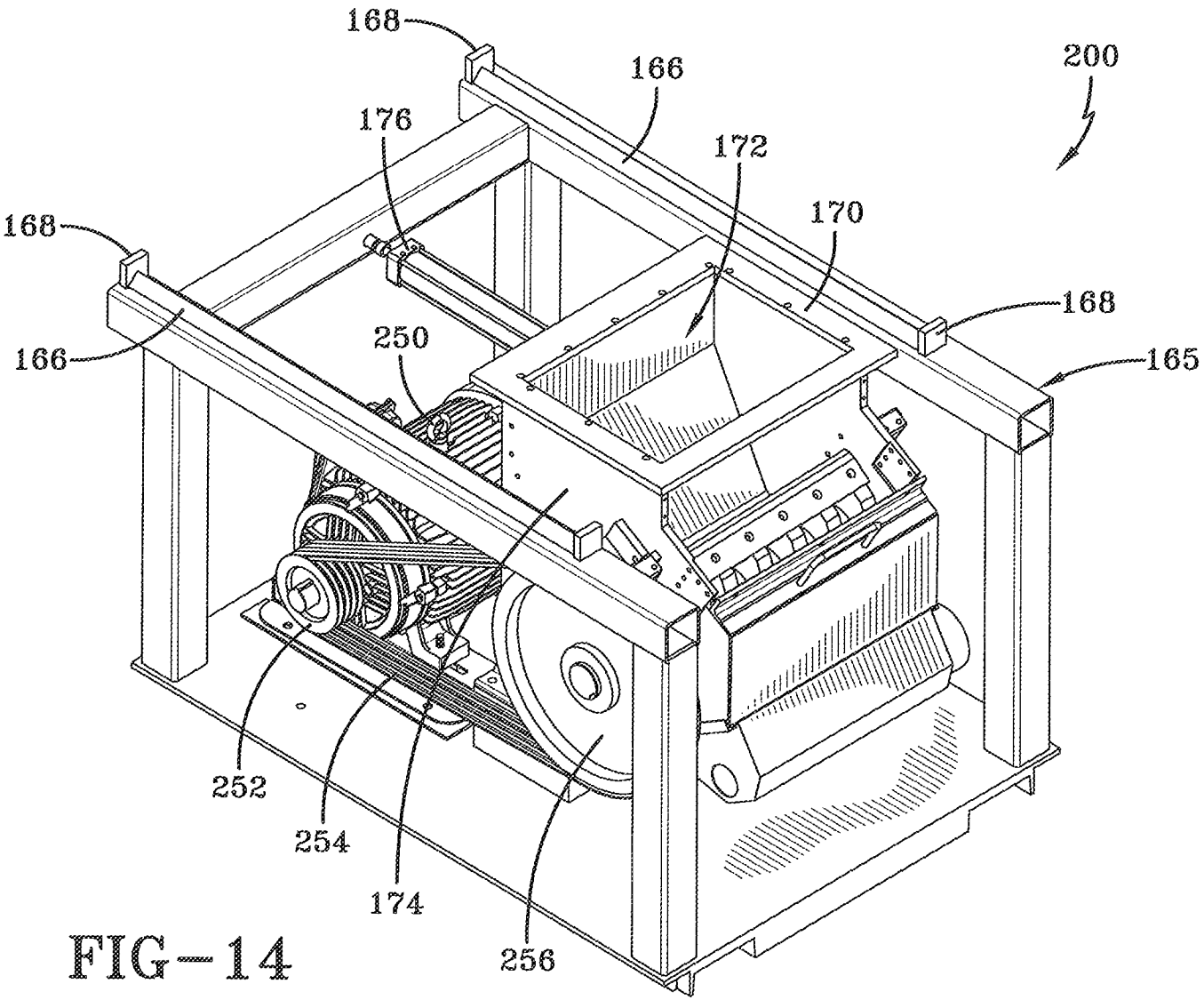
FIG. 14 is a perspective view of the grinder assembly with its cabinet panels removed according to the concepts of the present invention.

Referring now to FIG. 14, it can be seen that the cabinet frame 165 supports a grinder motor assembly 250 which may be connected to the control system 85. The motor assembly 250 rotates a motor drive pulley 252 which rotates and moves a grinder belt 254. The grinder belt is also associated with a shaft pulley 256, which engages an end of the grinder shaft 202 so as to rotate the grinder shaft assembly 200. In the present embodiment, the grinder motor assembly rotates at about 500 rpm.

The control system 85, best seen in FIG. 1, controls and provides for safety components related to the operation of the grinder motor assembly 250 and the shredder motor assembly 155. Skilled artisans will also appreciate that there may be safety switches associated with operation of the hood lift assembly such that the motor assemblies do not operate if the hood is in an open position. Additionally, safety switches may be associated with the shredder assembly such that none of the motor assemblies will operate if the shredder assembly is moved into an open position that allows access to the grinder shaft assembly. Other safety features may be provided as appropriate.

Based on the foregoing the advantages of the present invention are readily apparent. The movable feature of the hood lift assembly allows for the hood to be removed from the chopper housing so as to allow access to the cutter shaft assemblies. Moreover, the cutter shaft assemblies are removable from the chopper housing to as to allow for replacement of the cutter blades and for replacement of any of the other component parts associated therewith. Still yet another advantage is the movable nature of the shredder assembly with respect to the grinder assembly. By moving the shredder assembly back along the rails, access can be gained to an upper portion of the grinder assembly. This allows for replacement of the grinder shaft blades as needed. If further servicing is required, then the entire grinder shaft assembly may be removed and maintenance done apart from the assembly 20. The modular features of the assembly 20 allow for minimal down time of the assembly such that component parts can be swapped in and out so as to allow for parts to be replaced easily without disabling the machine for a significant period of time.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A modular shredder and grinder apparatus, comprising:

a grinder assembly having a grinder shaft assembly, said grinder assembly having a grinder opening; and a shredder assembly movable with respect to said grinder opening to allow access to said grinder shaft assembly, wherein scrap material is first fed into said shredder assembly so that shredded scrap material is received through said grinder opening and further cut by said grinder shaft assembly;

said shredder assembly comprising:

a chopper housing positionable over said grinder opening, said chopper housing having a chopper housing opening;

at least one cutter assembly carried by said chopper housing;

a hood assembly positionable over said chopper housing opening, said hood assembly comprising a chute body having a chute opening at one end to receive the scrap material and a chute plate with an opening therethrough at an opposite end of said chute body to allow the scrap material to be received in said chopper housing opening; and a hood lifting assembly coupled between said chopper housing and said chute body, said hood lifting assembly adapted to move said chute body between a closed position where said chute plate is in contact with said chopper housing and an open position where said chute plate is moved away from said chopper housing and exposes said at least one cutter assembly.

2. The apparatus according to claim 1, further comprising:

a grinder cabinet having said grinder opening therethrough;

a pair of opposed rails carried on opposed sides of said grinder cabinet; and said shredder assembly having a plurality of rollers extending therefrom and riding on said pair of opposed rails to move with respect to said grinder opening.

3. The apparatus according to claim 2, wherein said grinder shaft assembly comprises:

a grinder shaft;

a plurality of supports spaced apart and disposed on said grinder shaft, each said support having at least one blade notch, wherein said blade notches are aligned with each other; and a blade received in said blade notches.

4. The apparatus according to claim 1, wherein said at least one cutter assembly comprises:

a cutter shaft, said cutter shaft having a cutter key extending lengthwise for a majority of said cutter shaft; and a plurality of cutter blades disposed on said cutter shaft and oriented with respect to one another by said cutter key.

5. The apparatus according to claim 4, further comprising:

a plurality of spacers interleaved with said plurality of cutter blades and disposed on said cutter shaft, wherein each said cutter blade is removable from said cutter shaft for replacement.

6. The apparatus according to claim 5, wherein each said cutter blade comprises:

a body having a shaft opening therethrough, said shaft opening having a shaft keyway that is slidably received on said cutter key, said body having at least one insert opening;

a cutter insert received in said insert opening, said cutter insert having a cutting edge, wherein each said cutter blade has an angular orientation of said shaft keyway so that one of said plurality of cutter blades adjacent another of said plurality of cutter blades are non-aligned with each other.

7. The apparatus according to claim 5, wherein said chopper housing rotatably receives a pair of said cutter assemblies, wherein each said cutter assembly rotates in a direction opposite said other cutter assembly, and wherein a first said cutter assembly is interleaved with a second said cutter assembly such that adjacent said plurality of cutter blades from said first cutter assembly pass between adjacent said plurality of cutter blades from said second cutter assembly during their rotation.

8. The apparatus according to claim 7, further comprising;

a plurality of wipers inwardly extending from said chopper housing, each said wiper fitting in between said plurality of cutter blades from either said first or second cutter assembly.

9. The apparatus according to claim 1, wherein said at least one cutter assembly comprises:

a cutter shaft, said cutter shaft having a cutter key extending lengthwise for a majority of said cutter shaft;

a plurality of cutter blades disposed on said cutter shaft and oriented with respect to one another by said cutter key;

a plurality of spacers interleaved with said plurality of cutter blades and disposed on said cutter shaft, wherein each said cutter blade is removable from said cutter shaft for replacement; and wherein said chopper housing rotatably receives a pair of said cutter assemblies, wherein each said cutter assembly rotates in a direction opposite said other cutter assembly, and wherein a first said cutter assembly is interleaved with a second said cutter assembly such that adjacent said plurality of cutter blades from said first cutter assembly pass between adjacent said plurality of cutter blades from said second cutter assembly during their rotation.

10. A modular shredder and grinder apparatus comprising:

a grinder assembly having a grinder shaft assembly, said grinder assembly having a grinder opening;

a shredder assembly movable with respect to said grinder opening to allow access to said grinder shaft assembly, wherein scrap material is first fed into said shredder assembly so that shredded scrap material is received through said grinder opening and further cut by said grinder shaft assembly;

a grinder cabinet having said grinder opening therethrough;

a pair of opposed rails carried on opposed sides of said grinder cabinet; and said shredder assembly having a plurality of rollers extending therefrom and riding on said pair of opposed rails to move with respect to said grinder opening;

wherein said shredder assembly further comprises:

a chopper housing positionable over said grinder opening, said chopper housing having a chopper housing opening; and at least one cutter assembly carried by said chopper housing; and a hood assembly positionable over said chopper housing opening, said hood assembly comprising a chute body having a chute opening at one end to receive the scrap material and a chute plate with an opening therethrough at an opposite end of said chute body to allow the scrap material to be received in said chopper housing opening, wherein said chute plate is adapted to move with respect to said chopper housing to allow access to said at least one cutter assembly.

* * * * *